United States Patent [19]

Chatard et al.

[11] 4,145,014

[45] Mar. 20, 1979

[54] METHOD AND DEVICE FOR AUTOMATICALLY POSITIONING A FLEXIBLE ELONGATE MEMBER IN A STORAGE BASKET ROTATABLE ABOUT A VERTICAL AXIS

[75] Inventors: Michel Chatard; Guy Pignard, both of Rueil Malmaison; Jean Thiery, Le Pecq, all of France

[73] Assignee: Institut Francais du Petrole, France

[21] Appl. No.: 850,827

[22] Filed: Nov. 11, 1977

[30] Foreign Application Priority Data

Nov. 22, 1976 [FR] France ..... 76 35310

[51] Int. Cl.[2] ..... B21C 47/00

[52] U.S. Cl. ..... 242/83; 242/54 R

[58] Field of Search ..... 242/82, 83, 54 R, 79

[56] References Cited

U.S. PATENT DOCUMENTS

| | | | |
|---|---|---|---|
| 3,817,466 | 6/1974 | Reynard | 242/83 |
| 3,837,592 | 9/1974 | Thiery | 242/83 |
| 3,941,146 | 3/1976 | Chatard | 242/83 |

*Primary Examiner*—Edward J. McCarthy

*Attorney, Agent, or Firm*—Craig & Antonelli

[57] ABSTRACT

This device comprises means for handling a flexible elongate member, in combination with means for automatically controlling said handling means in response to a detected deformation of the loop portion formed by the flexible member near the storage basket, so as to bring this loop portion back to a preselected geometrical configuration.

9 Claims, 2 Drawing Figures

Ro

METHOD AND DEVICE FOR AUTOMATICALLY POSITIONING A FLEXIBLE ELONGATE MEMBER IN A STORAGE BASKET ROTATABLE ABOUT A VERTICAL AXIS

BACKGROUND AND SUMMARY OF THE INVENTION

The present invention relates to a method and a device for automatically positioning a flexible elongate member in a storage basket rotatable about a vertical axis.

By flexible elongate member it is meant here any elongate member which can be reeled, such as a cable or a tube, in particular a pipe for conveying fluids, or also a flexible drill pipe to which is secured a bottom-hole motor driving the drill bit.

The invention will be more particularly described hereinafter (but this must not be construed as limitative) in its application to a drilling apparatus comprising a flexible drill pipe passing through a drawing device and reeled in a cylindrical storage basket rotating about a vertical axis, the pipe being laid into this basket in coaxial successive turns or convolutions.

In such an apparatus, the rotation speed of the storage basket must be controlled not only as a function of the speed of advance or feeding rate of the pipe through the drawing device, but also in dependence with the radius of curvature of the turns of the elongate member reeled in the basket or unreeled from the latter, the value of this radius varying considerably (for example increasing twofold during the rotation of the storage basket).

Moreover, during these operations, any accumulation of twisting or torsional stresses at some locations on the pipe, which might damage this pipe on the long run, must be avoided.

The invention solves the first problem by controlling at best the speed of rotation of the storage basket in dependence with the two above-mentioned parameters, i.e. the feeding rate of the pipe through the drawing device and the radius of curvature of the turns in the storage basket.

The second problem is simultaneously solved by the invention by providing, both when unreeling and when reeling the pipe, one and the same geometrical configuration of the pipe portion which is connected to the storage basket, irrespective of the value of the reeling radius in this basket, thereby obtaining, during the unreeling of the pipe, a substantial compensation of the torsional stresses generated by reeling this pipe.

These two objects are achieved, according to the invention, by a method of positioning a flexible elongate member in a storage basket rotatable about a vertical axis, this member passing in the vicinity of the basket on a direction-reversing device, which is displaceable in synchronism with the rotation of the storage basket, so as to place the elongate member in successive layers each of which is formed of a spiral winding, this method making use of handling means for reeling and unreeling the elongate member, and means for detecting the variations in the radius of curvature of the flexible elongate member in at least one point thereof and for controlling said handling means so as to reduce these variations.

The invention comprises detecting the shape variations of a loop portion between said direction reversing means and the storage basket, in the vicinity of the latter, and controlling said handling means in dependence with the so-detected shape variations, so as to bring said loop portion back to a preselected geometrical configuration.

Since the weight of a storage basket for a flexible drill pipe may reach several hundreds metric tons, it may be difficult, except with a high power consumption, to provide means for rotating the basket capable of rapidly adapting its rotation speed to the feeding rate or running speed of the pipe through the pulling means, this rate depending on the drilling rate, which is in turn a function of the characteristics of the geological formations traversed by the borehole.

The flexible pipe may therefore form a second free loop portion between two direction reversing devices respectively located near the pulling device and near the storage basket, so that the variations in length of this second free loop portion automatically compensate for any difference between the running speed of the pipe through the drawing device and its reeling rate in the storage basket.

In the case where such an arrangement is made, the invention is advantageously carried out by means of an automatic device for positioning a flexible line in a storage basket, rotatable about a vertical axis, this device combining two control systems which comprise first control means actuating said means for rotating the storage basket, in response to the deformation of one of said loop portions by varying the rotation speed of the basket, so as to reduce said deformation, and a second control system which comprises an auxiliary traction device for pulling the elongate member and second control means actuating said auxiliary traction device in response to the deformations of the other loop portion so as to bring said other loop portion back to a preselected geometrical configuration.

From French Pat. No. 2,165,322 it is already known to make use of a device for automatically positioning in a storage basket, rotatable about a vertical axis, the turns or convolutions formed by a flexible elongate member, this device comprising an automatic control system. However, this prior device does not comprise means for maintaining substantially unchanged the geometrical shape of the loop portion of the elongate member connected to the storage basket so as to provide, when unreeling the flexible member, a substantial compensation of the torsional stresses generated when reeling this elongate member.

Such a characteristic cannot either be found in French Pat. No. 1,461,032 describing a process and an apparatus for offshore operations which does not make use of a derrick, this apparatus only comprising means for adjusting the reeling rate of the pipe, said means being controlled by a detector limiting to a maximum permissible value the bending which the elongate member is subjected to.

BRIEF DESCRIPTION OF THE DRAWINGS

An embodiment of the invention is described hereinunder with reference to the accompanying drawings, wherein.

DETAILED DESCRIPTION OF THE DRAWINGS

Figures 1, 2:
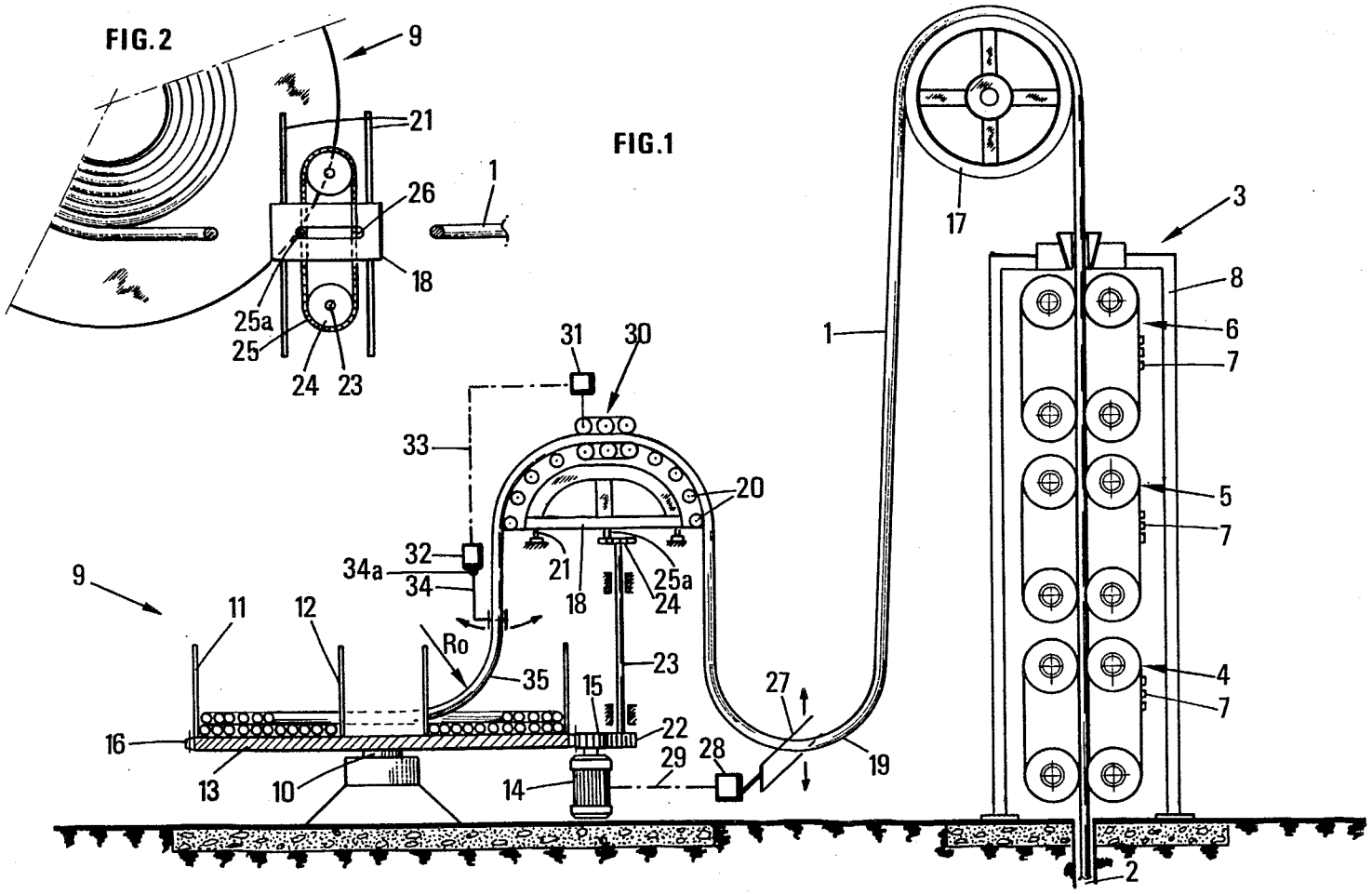
FIG. 1 is a diagrammatic view of a device according to the invention.
FIG. 2 is a view from above of the means for positioning the pipe in the basket.

In FIG. 1, reference 1 designates a flexible drill pipe lowered into a borehole 2 above which this pipe is supported by suitable drawing means 3, which may for example consist of a plurality of elements 4, 5, 6 . . . comprising endless chains carrying clamping shoes 7, these elements being housed in a frame 8 and actuated in synchronism by driving means of any known type (not shown).

Near the device 3 is located an annular basket 9 for storing the flexible pipe, this pipe, carried by a frame 10, being rotatable about a vertical axis (through hydraulic and electric rotary connector, not shown, pipe 1 is supplied with drilling fluid and data are received from the hole bottom and instructions are transmitted thereto).

The storage basket 9 is formed by two coaxial cylindrical frames 11 and 12 which delimit therebetween a storage space closed by a base plate 13 at its lower end and wherein pipe 1 is reeled in successive turns and layers.

The basket 9 can be rotated about its vertical axis through any suitable driving means, such as hydraulic or electric driving means, for example through motor 14 driving pinion 15 which meshes with a toothed crown surrounding the storage basket 9 and integral therewith.

Between device 3 supporting the pipe and the storage basket 9, the pipe 1 passes over two direction reversing devices 17 and 18 between which the pipe forms a free loop portion. The device 17 is, for example, a pulley carried on a stationary support member (not shown) and the device 18 is, in the illustrated embodiment, a roller path of semi-circular shape provided with rollers 20 carrying the pipe.

The direction reversing device 18 is displaceable along rails 21 substantially perpendicular to the plane of FIG. 1. This displacement is effected in synchronism with the rotation of the motor 14, so as to accurately position the pipe 1 in basket 9 with regularly spaced turns and to provide regular unreeling thereof.

As shown in FIGS. 1 and 2, this can be achieved, for example, through speed-reducing gears 22 driven by pinion 15 and actuating in turn, through shaft 23, a toothed wheel 24 whereon passes a chain 25 adapted to move by translation the direction reversing device 18.

This translation can be achieved through a pin 25*a* carried by chain 25 and passing through a slot 26 at the lower part of the direction reversing device 18 (FIG. 2).

The speed reduction ratio will be so adjusted that the displacement of the direction reversing device 18 along rails 21 be at least equal to the width (or diameter) of pipe 1 for each complete revolution of the storage basket 9.

This speed reduction ratio will be adjusted in accordance with the desired spacing of the convolutions in each pipe layer stored in the basket.

According to the invention, there is used a device which follows the variations in the running speed of the pipe through the pulling device 3 while maintaining, during the unreeling of the pipe, as well as during reeling thereof, the same geometrical shape of the loop portion 35 formed by pipe 1 between the direction reversing device 18 and the storage basket 9, this shape being independent of the radius of the pipe turn unreeled from the storage basket 9 or reeled therein.

This device comprises the combination of two control systems. The first system comprises a feeler 27 (for example a hinged rod) which follows the height variations of the loop portion 19 in a vertical plane, this feeler 27 being connected to an electric control device 28.

During reeling of the pipe the control device 28 connected to motor 14, through conductor 29, is adapted to start motor 14 driving basket 9 and then increase its rotation speed, when the feeler 27 is moved downwardly by the loop portion 19, and to slow down motor 14 and then stop it when the feeler 27 moves upwardly together with the loop portion 19.

The second control system comprises an auxiliary traction device 30 actuated by a motor 31, which may be located on the direction reversing device 18.

An electric control device 32 is connected to motor 31 through a conductor 33, this device being actuated by a hinged feeler 34, articulated at 34 A, which bears upon the loop portion 35 formed by pipe 1 between the direction reversing device 18 and the storage basket 9.

During reeling of the pipe the device 32 is adapted to start motor 31 driving the traction device 30, and the increase the rotation speed of this engine when the feeler 34 senses an increase in the radius of curvature of the loop portion 35.

The device 32 will slow down motor 31 and then stop it, when the feeler 34 senses a decrease in the radius of curvature of the loop portion 35.

DEVICE OPERATION

1° — Raising the pipe (a) Let us assume that basket 9 and the drawing device 3 being stopped, the traction device 3 is so actuated as to raise the pipe.

The loop portion 19 formed between the two direction reversing devices 17 and 18 is then moved downwardly and through device 28 the feeler 27 starts motor 14 driving the storage basket and then speeds up the rotation of this storage basket.

Consequently the loop portion 35 is stretched and the corresponding increase in the radius of curvature, which is sensed by the feeler 34, then starts and speeds up the rotation of the traction device 30, thereby resulting in an upward displacement of the loop portion 19 up to an equilibrium position at which the loop portion 35 will be restored to its initial radius of curvature $R_o$.

The value $R_o$ is independent of the location of the point at which the pipe is laid on the turns or convolutions already positioned in the storage basket 9, but depends on the number of turns already laid in this basket.

For the applications where this number of layers is high, it is possible to use a vertically displaceable feeler 34 and the height of this feeler above the storage basket will be varied according to the pipe length which has passed through this feeler, i.e. as a function of the number of pipe layers already laid on the basket, since each layer contains the same length of flexible pipe.

For example the feeler 34 will be moved vertically through an endless screw (not shown) actuated by the rotation of the storage basket, so that the distance between the feeler 34 and the upper layer of the flexible pipe be substantially constant.

(b) In a similar way, the two control systems will follow a reduction in the running speed of the pipe through the drawing device 3, by adjusting the rotation speed of motors 14 and 31, thus leading to a new state of equilibrium wherein the radius of curvature of the loop portion 35 has the same value $R_o$ as above and the lower point of the loop portion 19 is at the same level irrespective of the value of the reeling radius in the storage basket 9.

2° — Lowering the pipe

Any increase in the running speed of the pipe by the drawing device 3 results in an upward displacement of the loop portion 19 and a reduction in this running speed results in a lowering of this loop portion, but it can be seen again that the two control systems adapt themselves to this situation by reversing the sense of operation of the control devices 28 and 32 this leading to states of equilibrium wherein the radius of curvature of the loop portion 35 has always the value $R_o$ and the lower point of the loop portion 19 is at the same level, irrespective of the curvature radius of the turn which is unreeled from the storage basket 9.

Thus the device according to the invention properly follows the variations in the running rate of the pipe through the drawing device 3, by automatically adjusting the rotation speeds of motors 14 and 31, without any permanent change in the geometrical shape of the loop portion 35, as either during reeling or unreeling operations, irrespective of the reeling radius of the pipe in the storage basket 9.

Other embodiments may be contemplated without departing from the scope of the invention.

For example, the control device 32 can be connected to motor 14 which rotates the storage basket 9, the control device 28 being connected to motor 31 driving the auxiliary traction device 30.

In the case of direct control of motor 14 by device 32 it will also be possible to omit device 28 and the free loop portion 19 when the motor means 14 are powerful enough to rapidly respond to any actuation of device 32, so that the geometrical shape of the loop portion 35 remains substantially unchanged.

What we claim is:

1. A method for positioning a flexible elongate member in a storage basket rotatable about a vertical axis, said member passing, in the vicinity of the basket, on a direction reversing device displaceable in synchronism with the rotation of the basket, so as to properly position the elongate member in successive layers, each formed of a spiral winding, this method making use of a device for reeling and unreeling the elongate member including means for conveying said elongate member to and from said ket and means for rotating said storage basket as said elongate member is reeled and unreeled, this method comprising the step of sensing the variations of the radius of curvature of the elongate member in at least one point thereof and actuating one of said means for conveying or said means for rotating so as to reduce said variations, detecting any deformation from a given geometrical configuration of a loop portion comprised between said direction reversing means and the storage basket, in the vicinity of the latter and actuating said the other of said means for rotating and said means for conveying in response to the detected deformation, so as to bring said loop portion back to said given geometrical configuration.

2. A device for automatically positioning a flexible elongate member in a storage basket rotatable about a vertical axis, said member passing, in the vicinity of the basket, on a direction reversing device which is displaceable in synchronism with the rotation of the basket, so as to properly position the flexible member in the basket in successive layers, each formed by a spiral winding, this device comprising means for reeling and unreeling the elongate member, means for sensing variations in the radius of curvature of the flexible elongate member in at least one point thereof and means for controlling said means for reeling and unreeling so as to reduce said variations, said sensing means comprising means for sensing any deformation of the loop portion comprised between said direction reversing means and the storage basket, in the vicinity thereof, these sensing means being connected to means for controlling said means for reeling and unreeling in response to the detected deformation, so as to bring said loop portion back to a preselected geometrical configuration, which is substantially the same during reeling and unreeling of the flexible elongate member.

3. A device according to claim 2, wherein the flexible elongate member passes through a traction device and forms a free loop portion between said direction reversing device located near the storage basket and another direction reversing device located near the traction device, said means for the flexible elongate member comprising means for reeling and unreeling rotating the storage basket and an auxiliary traction device associated to said direction reversing device located near the storage basket, wherein said means sensing any deformation of the loop portion near the storage basket is combined with means for sensing the shape variations of the free loop portion, one of said detection means being connected to means for controlling said means for rotating the storage basket and the other of said detection means being connected to means for controlling said auxiliary traction means.

4. A device according to claim 2, wherein said detection means is connected to means controlling the speed of rotation of motor means driving the basket in rotation.

5. A device according to claim 3, wherein said sensing means comprise feeler means responsive to any deformation of said loop portions.

6. A method of positioning a flexible elongate member in a storage basket rotatable about a vertical axis wherein said member passes in the vicinity of the basket on a direction reversing device displaceable in synchronism with the rotation of the basket so as to properly position the elongate member in successive layers, each formed of a spiral winding, and wherein means are provided for conveying the elongate member to said basket and means are provided for rotating said storage basket, said method comprising the steps of sensing the variations of the radius of curvature of a loop portion of the elongate member between said storage basket and said direction reversing device and in response to the sensed variations controlling one of said means for conveying the elongate member and said means for rotating the storage basket so as to reduce said variations.

7. The method according to claim 6 further comprising sensing variations from a given geometrical position of a loop portion of the elongate member on the opposite side of said direction reversing device from said storage basket and controlling the other one of said means for conveying the elongate member and said means for rotating the storage basket so as to bring the loop portion on the ooposite side of said direction reversing device back to said given geometrical position.

8. In an arrangement for moving a flexible elongate member to and from a storage basket, rotatable about a vertical axis, via a direction reversing device positioned in the vicinity of said basket and displaceable in synchronism with the rotation of the basket so as to properly position the elongate member in successive layers, each formed of a spiral winding, comprising means for moving the elongate member to and from said basket and means for rotating said storage basket as said member is moved, the improvement comprising means for sensing variations in the radius of curvature along a portion of the elongate member between the direction reversing device and the storage basket and means for controlling one of said means for moving the elongate member and said means for rotating the storage basket in response to the sensed variations to reduce said variations.

9. The arrangement according to claim 8, further comprising means sensing variations from a given geometrical position of a loop portion of the elongate member on the opposite side of said direction reversing device from said storage basket and means for controlling the other one of the means for moving the elongate member and the means for rotating the storage basket in response to the sensed variations to bring said loop portion back to said given geometrical position.

* * * * *